US005557853A

United States Patent [19]

Andre et al.

[11] Patent Number: 5,557,853

[45] Date of Patent: Sep. 24, 1996

[54] AIR COOLED CLOTH CUTTING MACHINE

[75] Inventors: L. George Andre; Scott E. Andre, both of Cincinnati, Ohio

[73] Assignee: The Wolf Machine Company, Cincinnati, Ohio

[21] Appl. No.: 399,194

[22] Filed: Mar. 6, 1995

[51] Int. Cl.[6] ..... B26B 7/00

[52] U.S. Cl. ..... 30/275; 30/123.3; 83/936

[58] Field of Search ..... 30/123, 123.1, 30/273, 275; 83/936–941, 168, 169, 171, 170

[56] References Cited

U.S. PATENT DOCUMENTS

| | | | |
|---|---|---|---|
| 767,076 | 8/1904 | Mattison | 30/123.3 |
| 2,810,954 | 10/1957 | Clark | 30/123.3 |
| 3,346,954 | 10/1967 | Ulrich | 30/273 |
| 4,654,969 | 4/1987 | Schwartzott . | |
| 4,683,658 | 8/1987 | Stumpf | 30/275 |
| 4,782,591 | 11/1988 | DeVito et al. | 30/123.3 |

*Primary Examiner*—Scott A. Smith
*Attorney, Agent, or Firm*—Wood, Herron & Evans, P.L.L.

[57] ABSTRACT

A cloth cutting machine having a base mounted on at one end of an upright standard, and a motor mounted on the other end of that standard. A cloth cutting knife is connected to the standard, and is driven by the motor. A handle connected to the machine is manually gripped by the machine's operator to guide it during use. An air handler device connected to the machine is structured, in preferred form, to direct cooling air against the machine operator's hand which manually grips the handle. Also in preferred form, the cooling device includes a cooling air distribution manifold defined in the standard, that manifold having a hand air port at one end oriented to direct cooling air toward the handle, and a base air port at the other end which exhausts cooling air substantially rearwardly from the standard relative to the cutting direction of the machine so as to cool the standard.

11 Claims, 1 Drawing Sheet

AIR COOLED CLOTH CUTTING MACHINE

FIELD OF THE INVENTION

This invention relates to cloth cutting machines. More particularly, this invention relates to air cooled cloth cutting machines.

BACKGROUND OF THE INVENTION

Cloth cutting machines are widely used throughout various sewn products industries, e.g., the garment industry, for cutting or slitting stacks of fabric layers into various pattern designs. The cloth patterns so cut are used to make numerous articles such as clothes and the like. Cloth cutting machines are basically of two types. The first type is generally known as a straight knife machine where the cutting blade is a straight blade or knife, and this blade is vertically reciprocated by a motor attached to the machine. The second basic type is a circular knife machine where the knife blade is circular, and the blade is rotated in order to provide the cutting action on the cloth stack or the like. In both these types of machines, the knife blades are mounted on a standard between a machine base which slides or rolls over a cutting table, and a motor which drives the knife blade. And both these types of machines are provided with one or more manual handles by which an operator manually guides the cloth cutting machine relative to the cloth fabric stack to be cut in order to follow the pattern on the stack and, thereby, cut out the fabric sections as desired. The operator's work environment is often relatively hot to begin with, and use of the motor driven machine through a cloth fabric stack tends to add to the heat of the environment.

Accordingly, it has been the primary objective of this invention to provide a cloth cutting machine which is manually operable in which the machine's handle, and thereby the machine operator's hand which grips that handle during use, can be exposed to a relatively cool air flow so as to enhance operator comfort during use of the machine in the event of a warm working environment, e.g., in summer months, and can be exposed to a relatively warm air flow so as to embrace operator comfort during use of the machine in a cool working environment, e.g., in winter months.

It has been another objective of this invention to provide a cloth cutting machine in which the machine's standard is provided with a cooling air manifold that distributes cooling air from a cooling device first through a hand air port defined in the standard that is so oriented to direct cooling air toward the machine's handle, and second through a base air port defined in the standard adjacent the machine's base which is oriented to exhaust cooling air from the manifold substantially rearwardly of the standard relative to the cutting direction of the machine during use of it, thereby providing the double function through a single cooling air manifold of providing cooling air to an operator's hand when it grips the handle and providing cooling air to tend to cool the machine's standard during use of the machine.

SUMMARY OF THE INVENTION

In accord with these objectives, the cloth cutting machine of this invention comprises a standard with a cutting knife connected to that standard, the knife being supported in its cutting motion by the standard. A base is mounted to the standard at one end, and a motor connected to the knife is mounted to the standard at the other end. A handle is connected to the machine that is manually gripped by an operator to guide the machine during use of it. According to the principles of the invention, an air handler device is connected to the machine with that device being structured, in preferred form, to direct cooling air against the hand of an operator that manually grips the handle. Also in preferred form, the invention contemplates a cooling air distribution manifold defined in the standard with that manifold being connected to a cooling air source mounted on the machine. The cooling air distribution manifold defines at least one hand port that is oriented to direct cooling air toward the handle, thereby providing cooling air flow over that operator's hand which manually grips the handle during use of the machine. The cooling air distribution manifold also includes a base air port located adjacent the machine's base, that base air port being oriented to exhaust cooling air from the manifold substantially rearwardly of the standard relative to the cutting direction of the machine during use of it so as to cool the machine's standard without causing undue rippling of the cloth fabric stack being cut by the machine. This base air port is resistant to fabric residue clogging because it exhausts cooling air rearwardly of the standard even though it normally is located toward the bottom of a cloth stack during use of the machine.

DESCRIPTION OF THE DRAWINGS

Other objectives and advantages of this invention will be more apparent from the following detailed description taken in conjunction with the drawings in which.

DESCRIPTION OF THE PREFERRED EMBODIMENT

Figure 1:
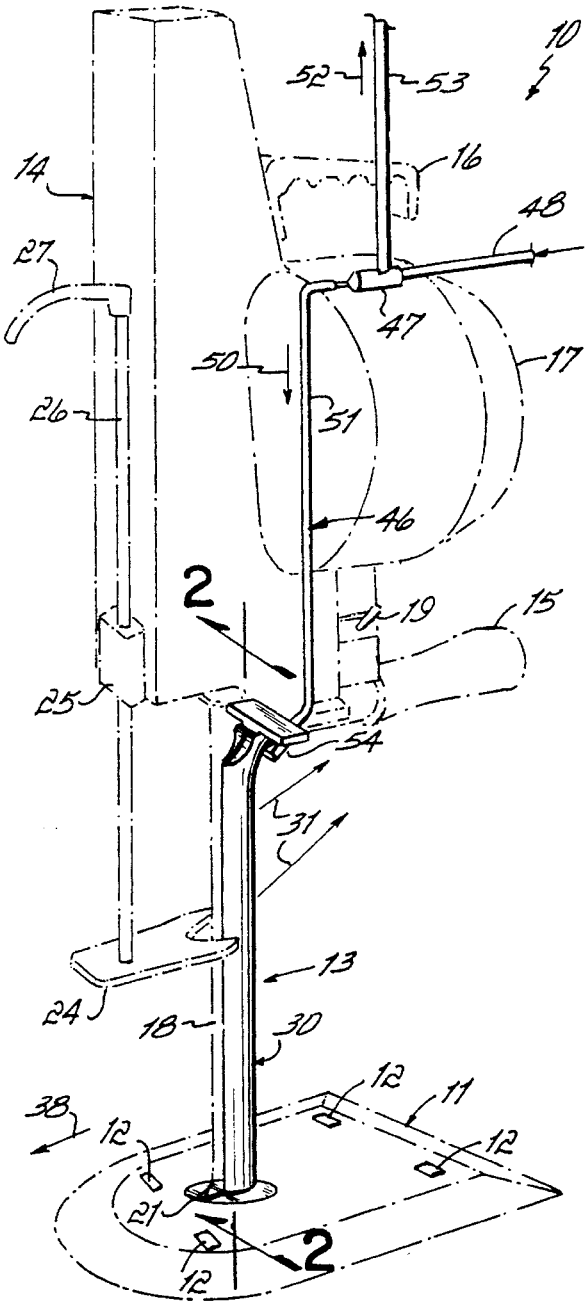
FIG. 1 is a perspective view illustrating a straight knife cloth cutting machine in accord with the principles of this invention.

The general environment of the invention is best shown and particularly illustrated in FIG. 1 where there is shown a straight knife type cloth cutting machine 10 having a base 11 with rollers 12 therein to permit free movement of the cloth cutting machine on a table surface (not shown). The table surface (not shown) will support a stack of fabric or cloth layers (not shown) to be cut by the cloth cutting machine 10. A vertical standard 13 extends upwardly from the base 12 and supports a housing 14. The machine housing 14 includes a drive mechanism (not shown) connected with electric motor 17 for continuously driving or reciprocating knife blade 18. A toggle switch 19 is mounted adjacent the bottom of the housing 14 to control the electric motor 17 and, thereby, the knife blade 18 reciprocation mechanism that is powered by that electric motor. Handles 15 and 16 are attached to the housing 14 to allow for manual guiding of the cloth cutting machine 10 across a table surface during use in order to allow the machine's operator to follow the cloth pattern design (not shown) outlined on the stack (not shown) of fabric or cloth layers.

Figure 3:
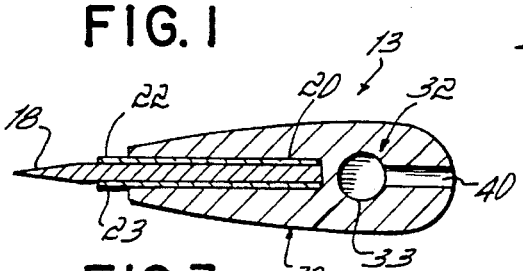
FIG. 3 is a cross-sectional view taken along line 3—3 of FIG. 2.

The straight knife blade 18 is supported within a recess or slot formed in the vertical standard 13, and is mounted for reciprocating movement into and out of a slot 21 formed in the machine's base, see FIGS. 1 and 3. The straight knife 18 is guided in its reciprocating movement relative to the standard 13 by knife guides 22, 23 fixed in place in the standard's slot 20 between the standard and the knife blade. A presser foot 24 is slideably connected to the machine housing 14 as at brackets 25, and is adjustable in height to bear against the top layer of the cloth stack (not shown) being cut. The upper end of the presser foot's slider post 26 terminates in a handle 27 for raising and lowering the presser foot 24. The machine 10 is operated during use, of course, by an operator manually gripping one or both of the handles 15, 16 connected to the machine so as to guide it in the desired cutting path.

Figure 2:
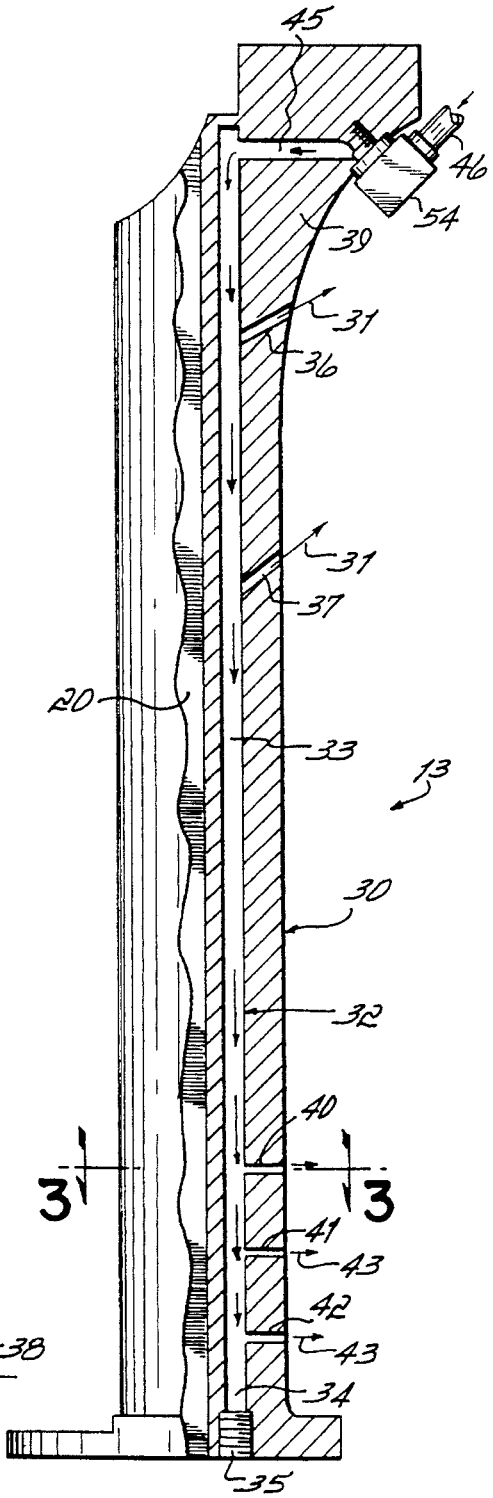
FIG. 2 is a cross-sectional view taken along line 2—2 of FIG. 1.

Now this invention is directed to an air handler device 30 connected to the machine 10. The air handler device 30 includes an air distribution manifold 32 defined in the standard as shown in FIG. 2, that manifold being in the form of a bore 33 that extends the length of the standard and is essentially oriented parallel to the straight knife blade 18. The bottom end 34 of the bore 33 is closed to atmosphere by a threaded plug 35 which may be removed periodically as necessary in order to blow out the manifold 32 and/or other components of the cooling device.

The air handler device 30 is structured, in preferred form, to direct cooling air (as shown by arrows 31) against the hand (not shown) of an operator which manually grips handle 15. Two hand air ports 36, 37 are defined in the standard, and are connected to the manifold bore 33 as shown in FIG. 2. These two hand air ports 36, 37 are oriented so as to direct cooling air 31 toward the handle 15. These two hand air ports 36, 37, therefore, are oriented to exhaust cooling air 31 from the manifold 32 substantially rearwardly of the standard 18 relative to the cutting direction 38 of the machine 10. And these two hand air ports 36, 37 are located adjacent the top end 39 of the air distribution manifold 32, i.e., of the standard 18.

The air handler device 30 also is structured, in preferred form, to cool the standard 18. Three standard base air ports 40–42 are defined in the standard 18 adjacent the base. These standard base air ports 40–42 are also oriented to exhaust cooling air (represented by arrows 43) from the manifold substantially rearwardly of the standard 18 relative to the cutting direction 38 of the machine 10 during use of it. Accordingly, flow of cool air through the manifold 32 and out through ports 40–42 tends to cool the standard, too.

The air distribution manifold 32, at its top end 39, is connected through bore 45 with air piping 46 that runs to a vortex tube 47 fixed to the cloth cutting machine 10, as shown in FIG. 1. The vortex tube 47 has the capacity to divide compressed air supplied to it in flow direction 48 through compressed air inlet piping into a cold air flow in flow direction 50 through cool air piping 51 and a hot air flow in flow direction 52 to atmosphere through exhaust air piping 53. The compressed air inlet tube 48 is connected by a suitable hose to an air compressor (not shown). Accordingly, the vortex tube 47 simply translates compressed air inlet flow 48 into a cooling air outlet flow component 50 which, in preferred form, is directed to the standard's manifold 32 and a hot air outlet flow component 52 which, in preferred form, is exhausted away from the operator through exhaust piping 52. Vortex tubes such as used herein are commonly known per se to industry, and a vortex tube 47 suitable for use in the cloth cutting machine environment of this invention currently can be purchased from Vortec Corporation, Cincinnati, Ohio 45242. The cooling air piping 51 from the vortex tube 47 to the manifold 32 is connected to the manifold through the inlet bore 45 in the standard and a fitting 54. The vortex tube 47, therefore, is a cooling air source connected to the cloth cutting machine 10. Alternatively, the vortex tube 47 can function as a warm air source for the standard's manifold 32 (and, hence, for the operator's hand) simply by connecting the exhaust air piping 53 to the manifold and directing the cool air piping 51 to atmosphere.

The air cooled cloth cutting machine 10 as described above, and in accord with the principles of this invention, in preferred form, thereby provides two benefits, i.e., provides a double function, from a single cooling air source, i.e., from a single vortex tube 47, connected to the machine. First, and importantly, cooling air 31 is directed to and over an operator's hand that manually grips handle 15 of the cloth cutting machine through the hand air ports 36, 37 connected to the air distribution manifold 32 adjacent the top end 39 of the standard. This obviously aids operator comfort during use of the cloth cutting machine 10. Second, the flow of cooling air through the manifold 32 during use of the machine 10 tends to cool the standard 13 itself because the air distribution manifold extends within the standard substantially throughout its length. And with the standard base air ports 40–42 defined in the standard adjacent the base 11, and because those standard base air ports are oriented to exhaust used cooling air 43 from the manifold 32 substantially rearwardly of the standard 13 relative to the cutting direction 38 of the machine during use of it, the cooling air exhaust flow 47 used to cool the standard does not unduly ripple the cloth stack (not shown) ahead of the knife blade 18 as the cloth stack is being cut by the machine. In other words, the cloth cutting pattern design of the cloth cutting stack (not shown) is not adversely affected by the cooling air flow 47 exhaust as would otherwise be the case if the cooling air flow was exhausted from the manifold 32 substantially forwardly of the standard 13 relative to the cutting direction 38 of the machine 10 during use of it.

Having described in detail the preferred embodiment of my invention, what I desire to claim and protect by Letters Patent is:

1. A cloth cutting machine, said machine being movable through a cloth stack in a cutting direction, said machine comprising a knife connected to a standard, said knife being supported by said standard, a motor connected to said knife, said motor being adapted to operate said knife, a handle connected to said machine, said handle being manually gripped by an operator to guide said machine during use of said machine, and an air handler device connected to said machine, said air handler device being structured to direct at least one of cooling air and warming air in a predetermined intentional air flow direction against that hand of an operator which manually grips said handle so that said hand is continuously exposed to said air flow when said hand grips said handle and said air handler device is operational both when said machine is stationary and not in operational relation with said cloth stack and when said machine is moving in said cutting direction through said cloth stack during use of said machine.

2. A machine as set forth in claim 1, said air handler device comprising at least one hand cooling air port defined in said standard, said at least one hand cooling air port being oriented to direct air flow toward said handle.

3. A machine as set forth in claim 2, said air handler device comprising an air source, and an air distribution manifold defined in said standard, said manifold being connected between said air source and said at least one hand cooling air port.

4. A machine as set forth in claim 3, said air source comprising a vortex tube connected to said manifold.

5. A machine as set forth in claim 3, said handle being mounted adjacent one end of said standard, said machine comprising a base being mounted adjacent an other end of said standard, said manifold extending within said standard substantially between said one and said other ends of said standard, and said air handler device comprising at least one base air port defined in said standard adjacent said base, said base air port being oriented to exhaust air flow from said manifold substantially rearwardly of said standard relative to said cutting direction during use of said machine.

6. A machine as set forth in claim 5, said air source comprising a vortex tube connected to said manifold.

7. A machine as set forth in claim 3, said machine comprising an access plug closing said manifold to atmosphere, said access plug being removable to allow cleaning of said manifold.

8. A cloth cutting machine, said machine being movable through a cloth stack in a cutting direction, said machine comprising a standard mounted on a base, a knife connected to said standard, said knife being supported by said standard, a motor connected to said knife, said motor being adapted to operate said knife, an air distribution manifold defined in said standard, said manifold extending within said standard substantially throughout the length of said manifold so that flow of cooling air through said manifold during use of said machine tends to cool said standard, and at least one base air port defined in said standard adjacent said base and connected adjacent one end of said manifold, said at least one base air port being oriented to exhaust cooling air from said manifold substantially rearwardly of said standard relative to said cutting direction during use of said machine so as not to unduly ripple ahead of said knife any part of said cloth stack being cut by said machine.

9. A machine as set forth in claim 8, said machine comprising a cooling air source connected to said manifold.

10. A machine as set forth in claim 9, said cooling air source comprising a vortex tube connected to said manifold, said vortex tube being connected adjacent that end of said manifold which is opposite to said at least one base air port.

11. A machine as set forth in claim 9, said machine comprising a handle connected to said machine, said handle being manually gripped by an operator to guide said machine during use of said machine, and at least one hand air port defined in said standard and connected to said manifold, said hand air port being oriented to direct cooling air toward said handle.

* * * * *